United States Patent [19]

Lavoie et al.

[11] Patent Number: 4,707,861

[45] Date of Patent: Nov. 24, 1987

[54] FOREARM SHIELD PAD

[76] Inventors: Fernand Lavoie, 1305 Ile St., Jean - Apt. 3, Terrebonne, Quebec, Canada, J6W 3M7; Yves Lepine, 2557 Crescent Holon, Lachine, Quebec, Canada, H7S 4C7

[21] Appl. No.: 2,987

[22] Filed: Jan. 13, 1987

[51] Int. Cl.[4] ..... A41D 13/08

[52] U.S. Cl. ..... 2/16; 2/17

[58] Field of Search ..... 2/16, 17, 18, 161 A, 2/2

[56] References Cited

U.S. PATENT DOCUMENTS

| | | | |
|---|---|---|---|
| 3,924,272 | 12/1975 | Allen et al. | 2/16 |
| 4,062,073 | 12/1977 | Rhee | 2/16 |
| 4,354,280 | 10/1982 | Hayes | 2/16 |
| 4,373,213 | 2/1983 | Ercandson | 2/16 |

FOREIGN PATENT DOCUMENTS

| | | |
|---|---|---|
| 900152 | 8/1972 | Canada . |
| 1070051 | 1/1980 | Canada . |

*Primary Examiner*—Doris L. Troutman

[57] ABSTRACT

A protective device for protecting a person from battery-following assault. The device comprises: a sturdy, rigid, elongated plate; a sheath surrounding the plate and made of a shock-dampening material; straps to releasably connect the palte sheath to a limb of the person and extending transversely of the longitudinal axis of the plate; and a pair of resilient, spaced, parallel rods fixedly mounted to the exterior face of the plate sheath, and extending longitudinally thereof to hold in position a rigid combat stick releasably engaged between said rods.

13 Claims, 3 Drawing Figures

FOREARM SHIELD PAD

FIELD OF THE INVENTION

This invention relates to shield pads for protecting a person's limbs and, more specifically, for protecting the forearm of a prison warden or the like person liable to be assaulted.

BACKGROUND OF THE INVENTION

Agressive behaviors are extremely frequent in prisons. Indeed, prison inmates are doing time specifically because they are inclined to such actions, having been found guilty of committing a criminal offense punishable in law by emprisonment. Such criminal offense generally constitutes an anti-social bahavior, perceived by the community as a threat to its harmony, integrity, and/or economy.

In prisons, the individuals most likely to suffer from these agressive behaviors are those who bear responsibility for the repressive authority therein, i.e. the wardens. This behavior can lead to assault and battery. Such assaults from inmates are generally blows given with the fist. However, striking weapons do get once and a while in the hands of inmates; they then can attack by a blow with a metal bar, or by a stab or a slash with a cutting weapon, e.g. These assaults can be extremely dangerous for the physical integrity of the warden during a planned collective assault, i.e. during a riot.

The prior art of body shielding devices could be divided in two: those for body parts and limbs in sports activities, such as in hockey, lacrosse, football, and the like; and those for protecting special task forces, policemen and armymen panels, which indlude bullproof vests, shield helmets, etc. Nothing exists specifically for prisons wardens, to the knowledge of the inventor, but, of course this is more of an offensive than of a defensive weapon. Moreover, the former catagory of sporting gown protective devices will not be effective against offensive weapons, such as knives, and the latter category of police and army-protective devices will be too cumbersome and heavy to carry for day-to-day use.

As outlined above, wardens do require some suitable bodily protection against battery from assault by inmates.

OBJECTS OF THE INVENTION

The gist of the invention is therefore to provide a defensive protection device specifically aimed at protecting a prison warden from battery-following assault by prison inmates.

A corollary object of the invention is that the above protective device be light in weight and unobstrusive.

A further object of the invention is that the above protection device is used in combination with an offensive weapon.

An important object of the invention is that the above protection device be concurrently able to temporarily support the striking club of the prison warden, which club increases the defensive protection of the device.

An object of the invention is to provide a forearm shield pad which also protects the elbow of the wearer.

SUMMARY OF THE INVENTION

In accordance with the objects of the invention, there is disclosed a shield pad which can be releasably secured to a forearm of a person by surrounding straps. The pad includes a sturdy, rigid core and a shock-dampening surrounding sheath. The exterior face of the pad includes a longitudinal channel member into which may be releasably engaged the cylindrical striking club of the prison warden. Thus, the warden needs only to displace his forearm at any position in front of his body, from feet to head, to protect the covered body portion with the shield pad from any battery as disclosed in the background of the invention. The present shield pad will not protect against a firearm shot, but this is not its primary purpose.

More generally speaking, the present invention consists of: a protective device for protecting a person from battery-following assault. The device comprises: a sturdy, rigid, elongated plate; a sheath surrounding said plate and made of a shock-dampening material; strap members to releasably connect the plate sheath to a limb of the person, and extending transversely of the longitudinal axis of said plate, and a resilient channel member fixedly mounted to the exterior face of said plate sheath, and extending longitudinally thereof, so as to receive a rigid stick therein.

Figure 1:
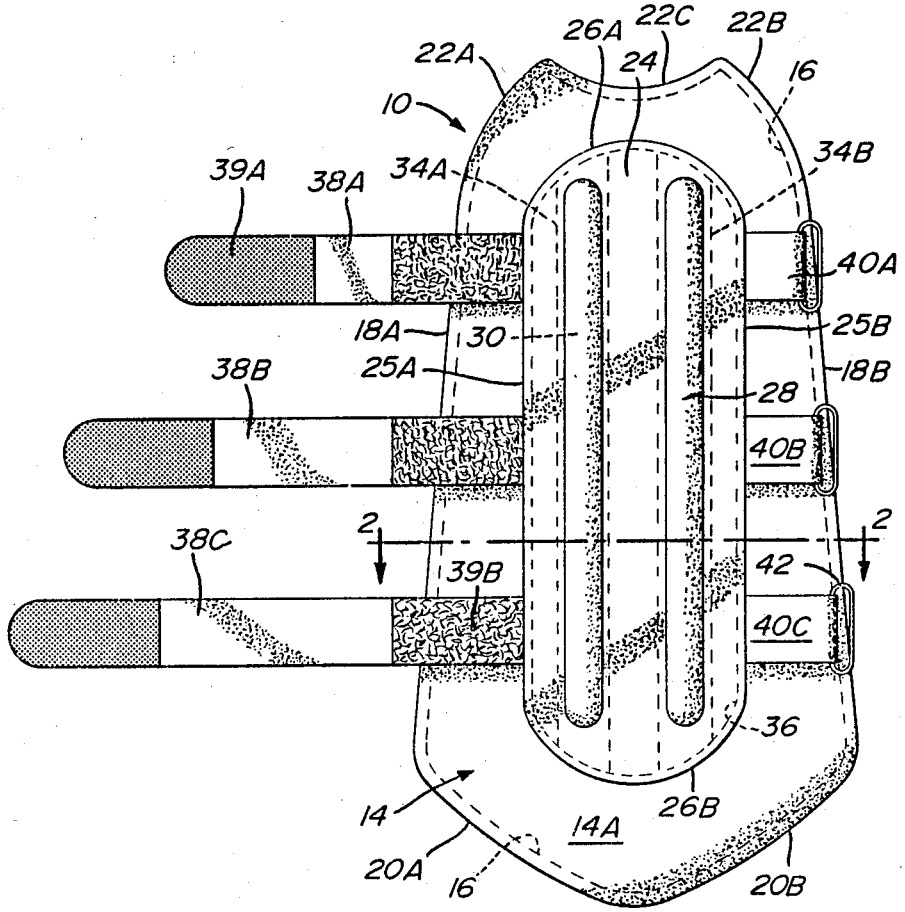
FIG. 1 is an exterior face plan view of a forearm-protective device according to the invention.
Figure 2:
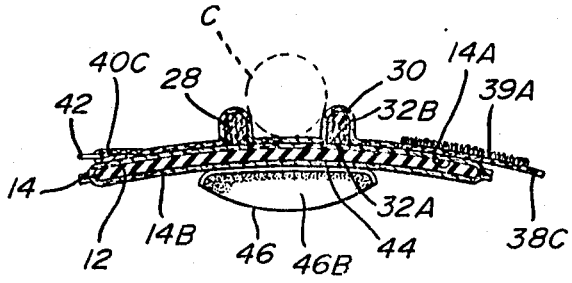
FIG. 2 is a cross-sectional view taken along lines 2—2 of FIG. 1.
Figure 3:
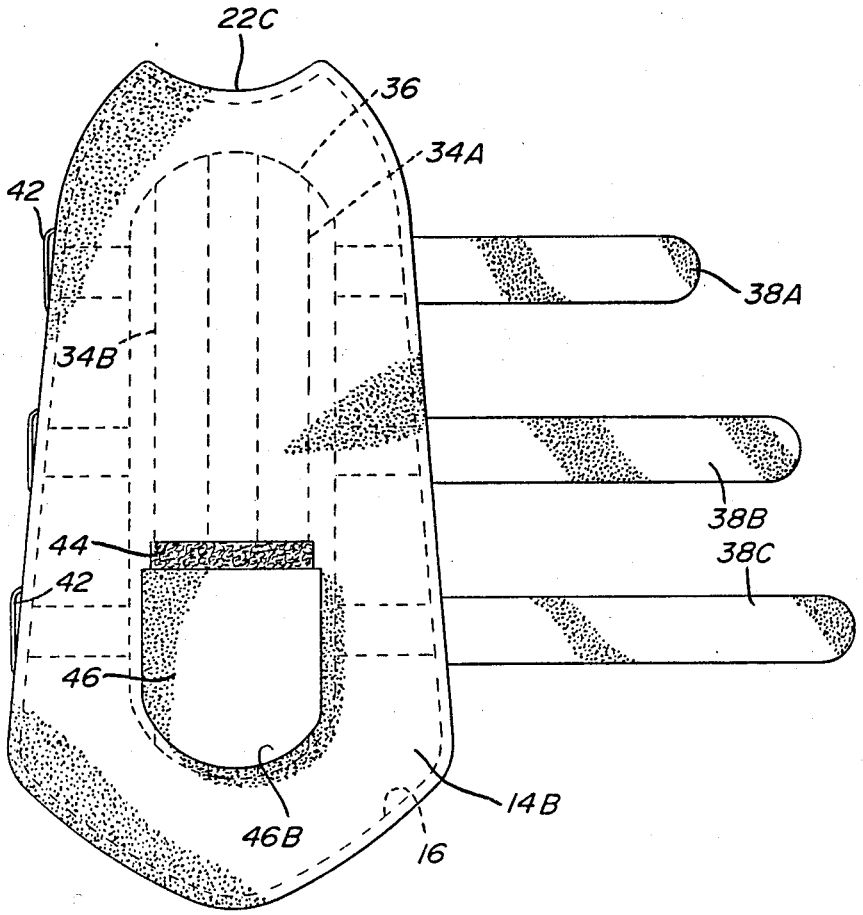
FIG. 3 is an interior face plan view of the protective device.

The protective device 10 comprises a main rigid plate 12 and a sheath of flexible fabric or leather 14, surrounding the plate and sewn at its periphery, at 16, to completely enclose this plate. Plate 12 is elongated and sheath 14 accordingly defines: two long upwardly-converging side edges 18A, 18B; a bottom substantially flattened V-shaped edge including two merging legs 20A, 20B; and a top edge having opposite corners convex portions 22A, 22B, and an intermediate concave portion 22C of a smaller radius of curvature than that of the convex edges 22A, 22B.

To the outer layer of the leather sheath 14, at 14A, is applied a sheet 24 of leather material. Sheet 14 is substantially rectangular, defining longitudinal side edges 25A, 25B, but for its convex top and bottom small ends 26A,26B, and is centrally positioned against layer 14A. Two identical elongated, spaced leather rods 28, 30 are sandwiched between sheet 24 and layer 14A, extending parallel to and equally spaced on each side of the central longitudinal axis of the plate 12. Each rod 28, 30 defines a flat inner face 32A and a convex outer face 32B. The inner faces 32A are flat for best adherence to the layer 14A, since it is to be glued thereon.

Each rod 28, 30 is further securable to layer 14A by two spaced longitudinal lines of stitching 34A, 34B, on each side of the corresponding rod and in close proximity therewith. The channel formed in between the rods 28–30, as determined by the position of the lines of stitching 34A–34B, should be such as to allow engagement therein of a conventional prison guard club C, so that the latter is held in position against lateral displacement relative to device 10. Such clubs C have a lateral handle near one end. The length of plate 12 represents about 50% or so of the length of the club C. The periphery of sheet 24 is further sewn to layer 14A by a further sew line 36.

A triplet of rectangular leather straps 38A, 38B, 38C extend spacedly one from other transversely of device 10, being secured to leather wall 14A starting from, and projecting outwardly from edge 18A. Top strap 38A, intermediate strap 38B, and bottom strap 3BC are of increasing length, respectively, since the forearm outer portion is sectionally smaller than its inner portion. From the side of sheet 24 spacedly transversely extend a triplet of leather straps 40A, 40B, 40C secured to sheath wall 14A and in longitudinal register with straps 38A, B-C, respectively. The outer end of each strap 40 is secured in a loop 40A, which is engaged by a metallic annular ring 42. Straps 40A-B-C are of slightly-increasing length.

The inner face 14B of sheath 14 is adapted to be applied against a forearm of a person, not shown, whereby the straps 38A-B-C may thereafter surround the forearm. The exterior face of each strap 38A-B-C includes an outer portion 39A and an inner portion 39B, spaced from the outer portion portion 39A, portions 39A and 39B supporting mating synthetic materials which adhere to one another when pressed against each other, constituting an adjustable fastener of the type known under the registered trade mark VELCRO.

Each outer portion 39A is of the same length for all the straps 38A,38B, 38C and, similarly, with each inner portion 39B. Each strap 38B-A-C may be made to engage through its registering hook 42 for at least the length of its outer portion 39A, wherein the outer portions 39A may then be folded back and adhered against the corresponding inner portions 39B of the straps 38A-B-C. Of course, depending on the sectional area of the forearm surrounded by straps 38A-B-C, the overall length of each closed folded strap 38A-B-C may be adjusted.

A small female >>Velcro>>, felt-like pad 44 is glued against sheath inner face 14B in between straps 38C and 40C, and within the lower portion of the area defined by stitching lines 36. A small shell 46, made of the rigid material of plate 12, and slightly larger than pad 44, is provided at its inner face with a male >>Velcro<< pad to be adjustably applied against pad 44. Shell 46 may be surrounded by a flexible fabric or leather sheath as with plate 12. Shell 46 defines a concave outer face 46B. Concave shell 46 is adapted to receive and shield the elbow of the person's forearm to which is secured pad 10. Accordingly, concave shell 46 may be displaced longitudinally of pad 44 for adjustment to persons having various lengths of forearm.

Pad 10 may be used as follows: when attached to the wearer's forearm by straps 38A to C, it may be used alone, as a shield, since rigid plate 12 is of sturdy construction. Pad 10 should be able to withstand not only heavy blows, such as with steel bars and the like, but should also protect the wearer from cuts by shearing devices, such as knives et al. The heart of the invention, however, lies in the use of the pad 10 in cooperation with the rigid club C, engaged in the channel defined between leather rods 28 and 30.

Prison warden clubs C generally include a lateral handle, not shown, which is grasped by the user's hand and stick C engaged in the channel between rods 30; the stick handle projects inwardly toward the wearer, through concave opening 22C. In this position, club C considerably increases the protecting efficiency of pad 10; and when needed for striking at uncooperative prison inmates, the club C is immediately available to the prison warden by manipulating with the same hand.

The present pad 10 is especially advantageous in preventing elbow injuries, which injuries are prevalent during riots in prisons, since the elbow engages within the concave reinforced pad 46, which thus surrounds same. Also, the pad 10 without the club C can further be used as an offensive weapon to strike rioting inmates on the head, e.g. or to push them against the wall or to the ground. Rigid plate 12 stops a blow or shearing device, while layers 14B, 14A, 24, and rods 28, 30 dampen the shock sustained by pad 10. Sheet 24 and sheath 14 may be made of leather, any strong fabric, rubber and polyethylene foam.

Shells 12, 46 may be made of any type of rigid material, such as aluminum, fiberglass, wood, polypropylene, A.B.S., polycarbonate.

It is envisioned that the wearer will wear a glove on his hand grasping the handle of club C, this glove carrying on the outside a layer of lead particles to act as a shock absorber and thus protect the back of the hand. Such a glove could be attached to concave edge 22C of pad 10.

What we claim is:

1. A protective device for protecting a person from battery following assault, the device comprising: a sturdy, rigid, elongated plate; a sheath surrounding said plate and made of a shock-dampening material; strap members to releasably connect the plate sheath to a limb of the person, and extending transversely of the longitudinal axis of said plate; and a resilient channel member fixedly mounted to the exterior face of said plate sheath, and extending longitudinally of said plate; said channel member adapted to receive a rigid stick applied against said exterior face to prevent its lateral displacement relative to said plate.

2. A protective device as in claim 1, wherein said channel member includes two spaced resilient rods, each defining a bottom flat face being glued to said plate sheath exterior face.

3. A protective device as in claim 2, further including a sheet of shock-dampening material covering said rods and stitched to said plate sheath exterior face, including a pair of stitching lines in register with the corresponding 1ongitudinal sides of each of said rods, to bias the latter against said plate sheath.

4. A protective device as in calim 3, said rods are made of leather.

5. A protective device as in claim 2, wherein said resilient rods are parallel to one another and equally spaced on the opposite sides of the central longitudinal axis of said plate.

6. A protective device as in claim 1, for use in connection with the user's forearm, further including an elbow-protecting member, mounted about the lower portion of the plate sheath interior face.

7. A protective device as in claim 6, wherein said elbow-protecting member includes a small rigid shell, said shell including a flat face and an opposite concave face, the flat face of the small, rigid shell secured to the lower portion of the plate sheath interior face.

8. A protective device as in claim 7, further including means to adjust the longitudinal position of said small rigid shell relative to the plate sheath.

9. A protective device as in claim 7, wherein said rigid plate and rigid shell are made of a material chosen from the group consisting of polypropylene, polycarbonate, A.B.S., wood, fiberglass, and aluminum.

10. A protective device as in claim 3, wherein said shock-dampening sheet is made of a material chosen from the group consisting of: leather, rubber, polyethylene foam and fabric.

11. A protective device as in claim 7, wherein said plate sheath is made of a material chosen from the group consisting of: leather, rubber, polyethylene foam, and fabric.

12. A protective device as in claim 7, wherein said strap members include at least one short top strap and another longer bottom strap, each of the straps transversely projecting from one side edge of said plate and being secured to said plate sheath exterior face; and rigid ring members, one for each strap, secured to said plate sheath exterior face at the other side edge of said plate in transverse register with its corresponding strap for engagement by the latter; said straps insertable through their registering ring; and means to adjustably and removably secure the outer end of each strap to an intermediate portions of the same strap.

13. A protective device as in claim 5, wherein the top edge of said plate has an intermediate concave portion.

* * * * *